US012543872B2

(12) United States Patent
Pettit et al.

(10) Patent No.: US 12,543,872 B2
(45) Date of Patent: Feb. 10, 2026

(54) DUVET

(71) Applicant: Purple Innovation, LLC, Lehi, UT (US)

(72) Inventors: Janae Lois Pettit, Pleasant Grove, UT (US); Arthur McConkie Ah Loo, Clearfield, UT (US)

(73) Assignee: Purple Innovation, LLC, Lehi, UT (US)

( * ) Notice: Subject to any disclaimer, the term of this patent is extended or adjusted under 35 U.S.C. 154(b) by 392 days.

(21) Appl. No.: 18/097,815

(22) Filed: Jan. 17, 2023

(65) Prior Publication Data

US 2023/0225525 A1 Jul. 20, 2023

Related U.S. Application Data

(60) Provisional application No. 63/299,671, filed on Jan. 14, 2022.

(51) Int. Cl.
*A47G 9/02* (2006.01)

(52) U.S. Cl.
CPC ..... *A47G 9/0207* (2013.01); *A47G 9/0261* (2013.01)

(58) Field of Classification Search
CPC ..... A47G 9/02; A47G 9/0207; A47G 9/0223; A47G 9/0261; A47G 9/04; A47G 2009/0269; A47G 2009/0276
See application file for complete search history.

(56) References Cited

U.S. PATENT DOCUMENTS

| | | | | |
|---|---|---|---|---|
| 7,181,790 | B2 * | 2/2007 | Wirtz | A47G 9/0261 5/482 |
| 8,458,832 | B1 * | 6/2013 | Krishna | A47G 9/0261 5/501 |
| 10,881,225 | B1 * | 1/2021 | Bernick | A47G 9/0207 |
| 11,490,748 | B1 * | 11/2022 | Ogedengbe | A47G 9/0261 |
| 11,659,944 | B2 * | 5/2023 | Phan | A47G 9/0261 5/501 |
| 11,825,951 | B2 * | 11/2023 | Teleshevsky | A47G 9/0223 |
| 2005/0144721 | A1 * | 7/2005 | Linnane | A47G 9/0261 5/501 |
| 2011/0023235 | A1 * | 2/2011 | Gold | A47G 9/0261 112/475.16 |
| 2011/0283453 | A1 * | 11/2011 | Low | A47G 9/0261 5/501 |
| 2014/0317844 | A1 * | 10/2014 | Jacobsen | A47G 9/0223 5/482 |
| 2016/0045043 | A1 * | 2/2016 | Tisius | A47G 9/0284 112/118 |
| 2018/0027998 | A1 * | 2/2018 | Heiman | A47G 9/0223 |
| 2018/0168372 | A1 * | 6/2018 | Pool | A47G 9/0207 |
| 2019/0099019 | A1 * | 4/2019 | Heiman | A47G 9/0261 |

(Continued)

*Primary Examiner* — George Sun
(74) *Attorney, Agent, or Firm* — Foley & Lardner LLP

(57) ABSTRACT

A duvet includes a duvet cover and an insert. The duvet cover includes a base and a top that that are secured to each other along fewer than three full edges (e.g., along one full edge and an adjacent part of one or two adjacent edge; along two full, adjacent edges; etc.). An upper surface of the top of the duvet cover may lack visible seams and fasteners. An interior surface of a base of the duvet cover may engage a surface of an insert positioned within a receptacle of the duvet cover, over the base (e.g., with touch fasteners, etc.). Methods for using duvet covers and duvets are also disclosed.

18 Claims, 3 Drawing Sheets

(56) References Cited

U.S. PATENT DOCUMENTS

| | | | | |
|---|---|---|---|---|
| 2019/0223630 | A1* | 7/2019 | Phan | A47G 9/0261 |
| 2020/0060447 | A1* | 2/2020 | Fravel | A47G 9/0261 |
| 2022/0167763 | A1* | 6/2022 | Farrell | A47G 9/0261 |
| 2023/0096184 | A1* | 3/2023 | Ogedengbe | A47G 9/0207 5/501 |
| 2023/0200572 | A1* | 6/2023 | Ginberg | A47G 9/0261 5/482 |

* cited by examiner

DUVET

CROSS-REFERENCE TO RELATED APPLICATION

A claim for priority to the Jan. 14, 2022 filing date of U.S. Provisional Patent Application No. 63/299,671, titled DUVET ("the '671 Provisional Application"), is hereby made pursuant to 35 U.S.C. § 119(e). The entire disclosure of the '671 Provisional Application is hereby incorporated herein.

TECHNICAL FIELD

This disclosure relates generally to duvets and, more specifically, to duvets with covers that include bases and tops that are secured to each other along fewer than three full edges. An upper surface of a duvet cover of this disclosure may lack visible seams and fasteners. An interior surface of a base of the duvet cover may engage a surface of an insert positioned within a receptacle of the duvet cover, over the base. Methods for using duvet covers and duvets are also within the scope of this disclosure.

RELATED ART

A duvet is a soft quilt that provides insulation for an individual. A duvet typically includes a duvet cover that removably receives an insert, such as a comforter or quilt. When used with a feather and/or down comforter, a duvet cover provides a barrier that prevents feathers within the comforter from scratching or poking an individual who uses the comforter. In addition, since a duvet cover can be removed from the comforter or other bedding, a duvet cover can be laundered frequently (e.g., with a bottom bed sheet), thus enabling individuals to use duvets without top bed sheets.

Conventionally, duvet covers have been configured as bags, with a base and a top that are sewn together along a bottom edge and two side edges, while the base and top are at least partially separable along a top edge of the duvet. Such a configuration may make it somewhat difficult to place a conventional duvet over a comforter or other bedding.

Since conventional duvet covers merely serve as covers for comforters or other bedding and duvet covers are separate from the bottom bed sheet, making a bed requires that the duvet be spread out over the mattress in the same manner as a bed spread, but often with the additional requirement that the relative positions of the duvet and the comforter or other bedding therein be adjusted to provide the duvet with a pleasing appearance in which the base and top of the duvet are properly superimposed about all of the edges of the duvet and the comforter or other bedding is spread out within the interior of the duvet.

SUMMARY

In one aspect, a duvet according to this disclosure includes a duvet cover with a base and a top that are sewn or otherwise secured to each other along fewer than three complete edges. In some embodiments, the top of the duvet cover may be permanently secured to the base of the duvet cover along an entirety of their bottom edges and along substantially an entirety of one side edge; the other side edges and the top edges of the top and base of the duvet may be removably securable to each other (e.g., with zipper halves, buttons and corresponding button holes, touch fasteners, ties, snaps, etc.). In other embodiments, the top of the duvet cover may be permanently secured to the base of the duvet cover along an entirety of their bottom edges and portions (e.g., bottom portions) of their side edges; remaining portions of the side edges and the top edges of the top and base of the duvet cover may be removably securable to each other (e.g., with zipper halves, buttons and corresponding button holes, touch fasteners, ties, snaps, etc.). Such configurations may enable the duvet cover to be removed from a comforter or other bedding more readily than a conventional duvet cover and simplify that process of positioning or repositioning the duvet cover over the comforter or other bedding.

In another aspect, a fastening system is designed to an insert, such as a comforter or other bedding, within a duvet cover. The fastening system may include cooperating fasteners on the insert and the base of the duvet cover. More specifically, fasteners (e.g., strips of touch fasteners, etc.) may be provided on a bottom surface of the insert, adjacent to edges of the bottom surface of the insert, while complementary fasteners (e.g., pieces of touch fasteners that can engage or be engaged by the strips of touch fasteners on the insert, etc.) may be provided adjacent to edges of the interior surface or upper surface of the base of the duvet cover. Thus, as the insert is properly arranged (i.e., bottom surface down) and positioned within a receptacle of the duvet cover, the fasteners on the insert can engage or be engaged by the inserts on the interior surface or upper surface of the base of the duvet cover to hold the insert in place within the duvet cover.

The duvet cover may include standard ties in the corners of its receptacle and corners of the insert may include loops to ensure that the duvet cover and the insert are compatible with conventionally configured components of a duvet (i.e., the duvet cover with a conventionally configured insert, the insert with a conventionally configured duvet cover).

Other aspects of the disclosed subject matter, as well as features and advantages of various aspects of the disclosed subject matter, should become apparent to those of ordinary skill in the art through consideration of the preceding disclosure, the accompanying images, and the appended claims.

DETAILED DESCRIPTION

The images and text that accompany this disclosure provide details of some non-limiting embodiments of duvets according to this disclosure.

Figure 1:
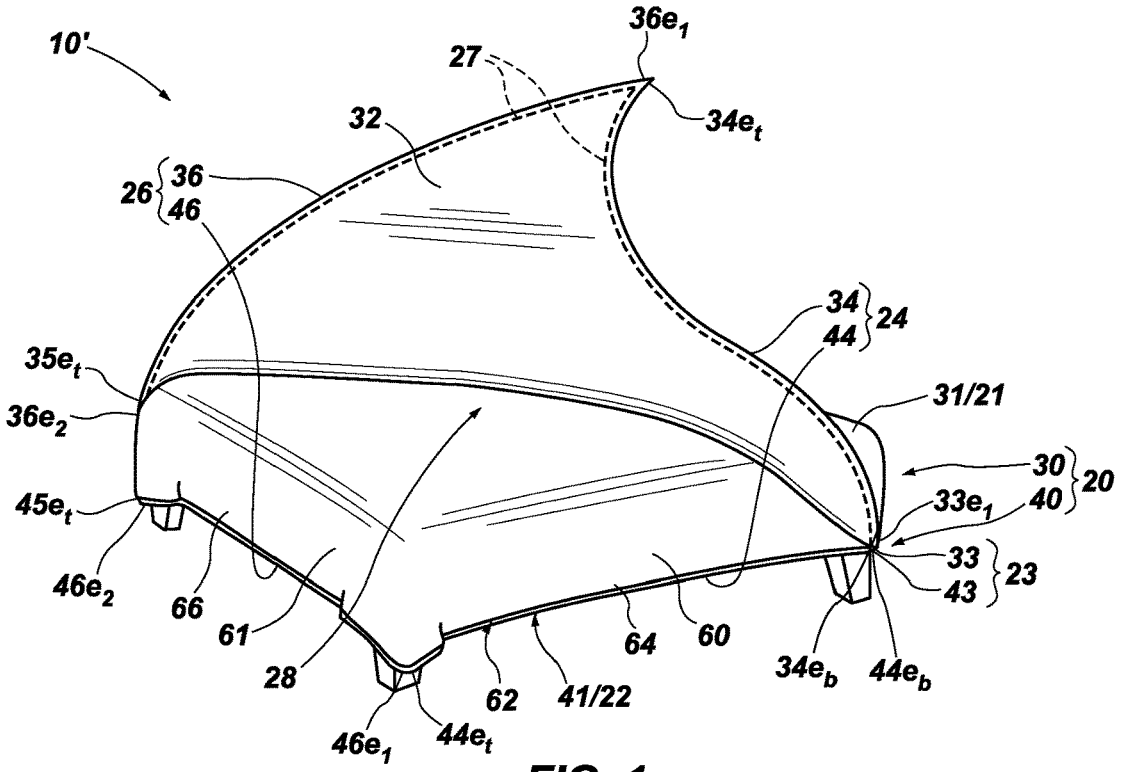
FIG. 1 is a perspective view of an embodiment of a duvet of this disclosure, including a duvet cover and an insert.

With reference to FIG. 1, an embodiment of a duvet 10 is depicted. The duvet 10 may include a duvet cover 20 and an insert 60. The duvet cover 20 is made to be positioned over the insert 60.

The duvet 10 may have a shape and size that facilitate is use with and provide an aesthetically pleasing cover on a particular size mattress. In various embodiments, the shape and dimensions of the duvet 20 may be appropriate for use on a king size bed (e.g., a standard king, a California king, etc.), a queen size bed, a full size bed, a twin bed, an extra long (XL) twin bed, etc. A king size duvet 10 may have dimensions of about 108 inches (about 275 cm) (e.g., width, etc.) by about 100 inches (about 250 cm) (e.g., length, etc.). A queen size or full size duvet 10 may have dimensions of about 90 inches (about 230 cm) (e.g., width, etc.) by about 95 inches (about 240 cm) (e.g., length, etc.). A twin duvet may have dimensions of about 63 inches (about 160 cm) (e.g., width, etc.) by about 92 inches (about 235 cm) (e.g., length, etc.).

As illustrated, the duvet cover 20 includes a top 30 and a base 40. The top 30 and base 40 are superimposed with each other, with a receptacle 28 defined between the top 30 and base 40. A configuration of the receptacle 28 (e.g., its shape, dimensions, etc.) enable it to receive the insert 60.

The top 30 of the duvet cover 20 includes an outer surface 31 and an inner surface 32. The outer surface 31 and the inner surface 32 are opposite from each other. The outer surface 31 may define an upper surface 21 of the duvet cover 20. The inner surface 32 may partially define the receptacle 28 of the duvet cover 20. The top 30 also includes a plurality of edges 33, 34, 35 (not shown), and 36.

Edge 33 of the top 30 of the duvet cover 20 may comprise a bottom edge of the top 30 of the duvet cover 20, with a first end 33$e_1$ and a second end 33$e_2$ (not shown). Edge 34 may comprise a first side edge of the top 30, with a top end 34$e_t$ and a bottom end 34$e_b$. Edge 35 (not shown) may comprise a second side edge of the top 30, with a top end 35$e_t$ and a bottom end 35$e_b$ (not shown). Edge 36 may comprise a top edge of the top 30, with a first end 36$e_1$ and a second end 36$e_2$.

The first end 33$e_1$ of the bottom edge 33 may be adjoined to the bottom end 34$e_b$ of the first side edge 34. The second end 33$e_2$ (not shown) of the bottom edge 33 may be adjoined to the bottom end 35$e_b$ (not shown) of the second side edge 35. The top end 34$e_t$ of the first side edge 34 may be adjoined to the first end 36$e_1$ of the top edge 36, with the first side 34 edge extending perpendicularly from the first end 36$e_1$ of the top edge 36. The top end 35$e_t$ of the second side edge 35 may be adjoined to the second end 36$e_2$ of the top edge 36.

The first side edge 34 and second side edge 35 (not shown) may be arranged or extend parallel to each other and perpendicular to the bottom edge 33 and the top edge 36. The bottom edge 33 and top edge 36 may be arranged or extend parallel to each other and perpendicular to the first side edge 34 and second side edge 35 (not shown).

The base 40 of the duvet cover 20 includes an outer surface 41 and an inner surface 42. The outer surface 41 and the inner surface 42 are opposite from each other. The outer surface 41 may define a lower surface 22 of the duvet cover 20. The inner surface 42 may partially define the receptacle 28 of the duvet cover 20. The base 40 also includes a plurality of edges 43, 44, 45 (FIG. 3), and 46.

Figure 3:
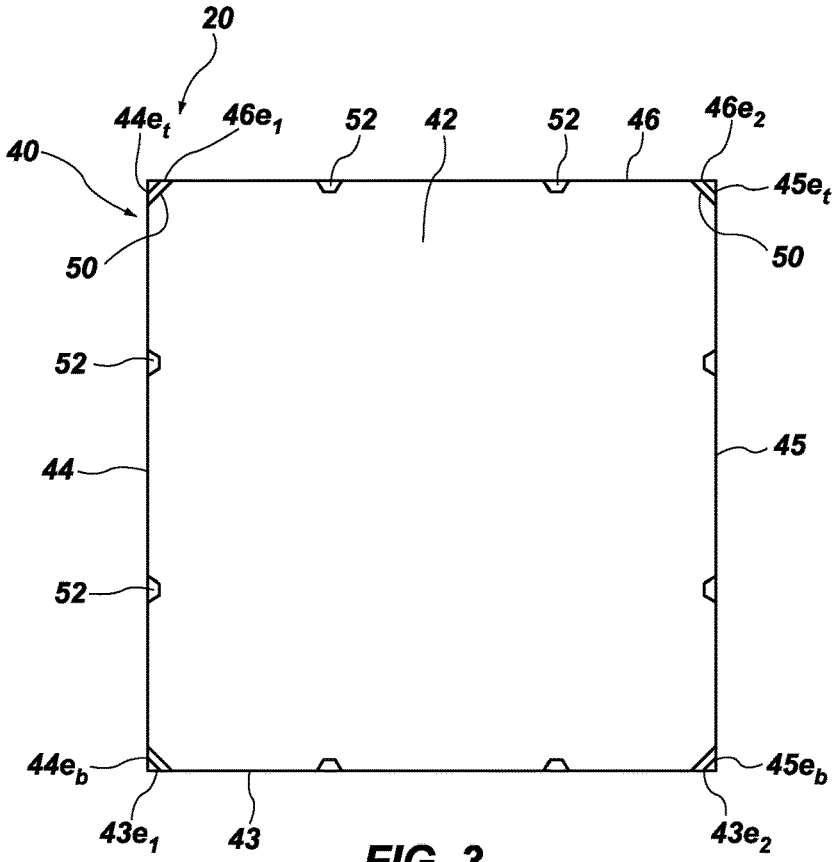
FIG. 3 is a top view of an embodiment of a base of a duvet cover of a duvet of this disclosure, showing an upper surface or inner surface of the base and an embodiment of insert fasteners on the upper surface.

Edge 43 of the base 40 of the duvet cover 20 may comprise a bottom edge of the base 40 of the duvet cover 20, with a first end 43$e_1$ and a second end 43$e_2$ (not shown). Edge 44 may comprise a first side edge of the base 40, with a top end 44$e_t$ and a bottom end 44$e_b$. Edge 45 (FIG. 3) may comprise a second side edge of the base 40, with a top end 45$e_t$ and a bottom end 45$e_b$ (FIG. 3). Edge 46 may comprise a top edge of the base 40, with a first end 46$e_1$ and a second end 46$e_2$.

The first end 43$e_1$ of the bottom edge 43 may be adjoined to the bottom end 44$e_b$ of the first side edge 44. The second end 43$e_2$ (not shown) of the bottom edge 43 may be adjoined to the bottom end 45$e_t$ (FIG. 3) of the second side edge 45 (FIG. 3). The top end 44$e_t$ of the first side edge 44 may be adjoined to the first end 46$e_1$ of the top edge 46, with the first side 44 edge extending perpendicularly from the first end 46$e_1$ of the top edge 46. The top end 45$_t$ of the second side edge 45 (FIG. 3) may be adjoined to the second end 46$e_2$ of the top edge 46.

The first side edge 44 and second side edge 45 (FIG. 3) may be arranged or extend parallel to each other and perpendicular to the bottom edge 43 and the top edge 46. The bottom edge 43 and top edge 46 may be arranged or extend parallel to each other and perpendicular to the first side edge 44 and second side edge 45 (FIG. 3).

At least one edge 33 of the top 30 of the duvet cover 20 and a corresponding edge 43 of the base 40 of the duvet cover 20 are permanently adjoined to each other to define a coupled edge 23 of the duvet cover 20. The coupled edge 23 may comprise a fold in fabric that defines at least portions of the top 30 and the base 40. Alternatively, the coupled edge 23 may be defined by sewing, adhering, bonding, or otherwise securing edge 33 of the top 30 to edge 43 of the base 40.

In some embodiments, such as that depicted by FIG. 1, an adjacent coupled edge 25 of the duvet cover 20 may be defined by permanently securing corresponding (e.g., superimposed, etc.) edges 34 and 44 of the top 30 and base 40, respectively, of the duvet cover 20 to each other. For example, substantially an entirety of the edge 35 (not shown) of the top 30 or an entirety of edge 35 (not shown) may be permanently secured to a same length (i.e., substantially an entirety or an entirety) of edge 45 (FIG. 3) of the base 40.

The remaining edges of the duvet cover 20, which edges may be referred to as "fastening edges 24 and 26," may have configurations that enable the edges 34 and 44, 36 and 46 of the top 30 and base 40, respectively, to be removably secured or reversibly to each other. For example, edges 34 and 44, 36 and 46 may include cooperating elements of a fastener 27 (e.g., zipper halves, buttons and corresponding button holes, touch fasteners, ties, snaps, etc.), which may enable edges 34 and 44 and/or edges 36 and 46 to be selectively coupled to and uncoupled from each other.

Figure 2:
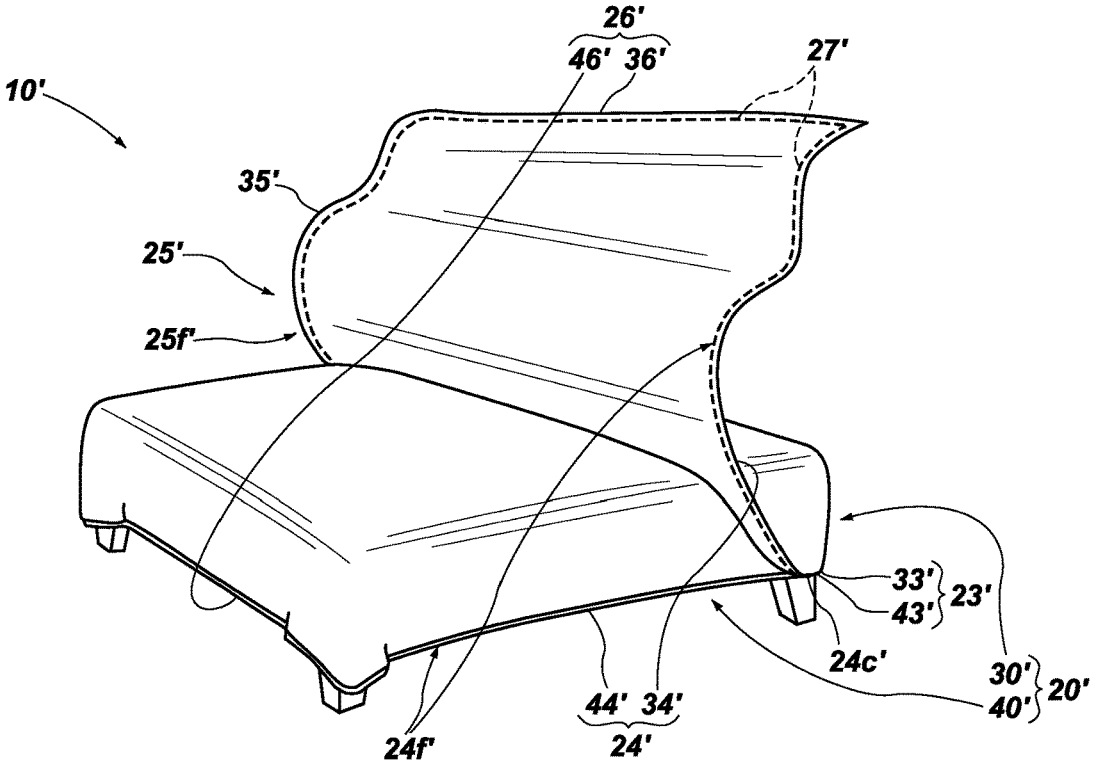
FIG. 2 is a perspective view of another embodiment of a duvet.

In other embodiments, like that shown in FIG. 2, a duvet cover 20' may include a coupled edge 23' with a partially coupled edge 24', 25' adjacent to each side of the coupled edge 24'. Each partially coupled edge 24', 25' may include a coupled portion 24$c'$, 25$c'$ (not shown) defined by a portion of the length of an edge 34', 35' of the top 30' of the duvet cover 20' nearest to a corresponding end of the coupled edge 23' that is secured to a corresponding (e.g., superimposed, etc.) portion of the lengths of an edge 44', 45' (not shown) of the base 40' of the duvet cover 20'. Without limitation, the coupled portion 24*c*', 25*c*' (not shown) of each partially coupled edge 24', 25' may comprise a tenth of the length of the coupled edge 24', 25', an eighth of its length, a sixth of its length, a fifth of its length, a fourth of its length, a third of its length, half of its length, etc., but not substantially all or all of its length.

The remainder of the length of the partially coupled edge 24', 25' is defined by portions of the lengths of edges 34' and 44', 35' and 45' (not shown) that may be selectively coupled to and uncoupled from each other, or removably secured or reversibly secured to each other, which portions may referred to as "fastening portions 24*f*, 25*f*" of the partially coupled edge 24', 25'. Cooperating elements of one or more fasteners 27' (e.g., zipper halves, buttons and corresponding button holes, touch fasteners, ties, snaps, etc.) may enable the fastening portions 24*f* and 25*f* (partially shown) to be selectively opened (by uncoupling appropriate portions of edges 34' and 44' and/or edges 35' and 45' (not shown) from each other) or closed (by coupling appropriate portions of edges 34' and 44' and/or edges 35' and 45' (not shown) to each other).

Likewise, the remaining edge 26' of the duvet cover 20', which edge may be referred to as a "fastening edge 26'," may have a configuration that enables the edges 36' and 46' of the top 30' and base 40', respectively, of the duvet cover 20' to be removably secured or reversibly secured to each other. For example, edges 36' and 46' may include cooperating elements of one or more fasteners 27' (e.g., zipper halves, buttons and corresponding button holes, touch fasteners, ties, snaps, etc.), which may enable the edges 36' and 46' to be selectively coupled to and uncoupled from each other.

As shown in FIG. 3, the inner surface 42 of an embodiment of the base 40 of the duvet cover 20 is shown. Fasteners 50, 52 are positioned over and carried by the inner surface 42 at or adjacent to the edges 43, 44, 45, and 46 of the base 40. The fasteners 50, 52 may be touch fasteners, such as the hook elements of a so-called "hook and loop" touch fastener (e.g., VELCRO brand hook 42A, etc.), with hooks that face in the same direction as the inner surface 42 of the base 40 (i.e., upwardly). Fasteners 50 may comprise strips that are positioned adjacent to corners of the base 40 and extend diagonally between each pair of adjoined edges 43 and 44, 44 and 45, 45 and 46, 46 and 43 that form the corners of the base 40 (e.g., at 45° angles to each pair of adjoined edges 43 and 44, 44 and 45, 45 and 46, 46 and 43; etc.). The ends of the fasteners 50 may be secured to the base 40 in a manner that defines a loop at each corner of the duvet cover 40. In some embodiments, fastening elements of the fasteners 50 (e.g., hooks, etc.) may be located on both surfaces of the fasteners 50, which may enable each fastener 50 to engage a complementary fastener (e.g., the binding 68 shown in FIG. 5 and described in further detail below, etc.) regardless of whether the complementary fastener is positioned over or under the fastener 50. Fasteners 52 may be positioned more centrally and may be spaced apart at intermediate locations along each edge 43, 44, 45, and 46 of the base 40. As illustrated, each fastener 52 may have the shape of half a regular hexagon, or a "half hex" shape. By securing the fasteners 50, 52 to the base 40 of the duvet cover 20, any stitching, adhesives, or bonding that secures each fastener 50, 52 to the base 40 may be hidden from view, under the duvet 10 (FIG. 1) when the duvet 10 is placed over a mattress (not shown).

Figure 4:
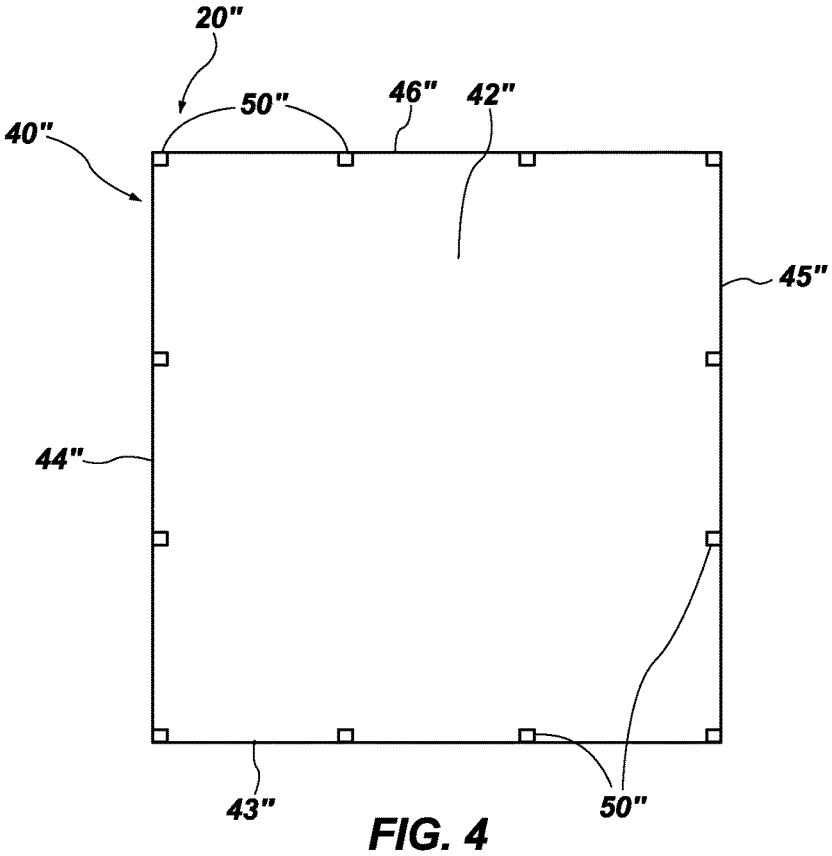
FIG. 4 is a top view of another embodiment of a base of a duvet cover of a duvet of this disclosure, showing an upper surface or inner surface of the base and an embodiment of fasteners on the upper surface.

FIG. 4 depicts another embodiment of a base 40" of a duvet cover 20", showing an inner surface 42" of the base 40". Fasteners 50" are positioned over the inner surface 42" at or adjacent to the edges 43", 44", 45", and 46" of the base 40", at corners of the base 40" and at intermediate locations along the length of each edge 43", 44", 45", 46" of the base 40". In some embodiments, each fastener 50" may be secured to the base 40" at a location (e.g., an edge, etc.) closest to its corresponding edge(s) 43", 44", 45", 46", while other portions (e.g., more centrally located portions, etc.) of the fastener 50" may remain unsecured to the base 40", providing a tab. A fastener 50" that comprises a tab that may lie against the inner surface 42" in a first orientation, be moved (e.g., hingedly, etc.), and reoriented (e.g., upside-down, etc.) in a second orientation. Each fastener 50" may be secured to (e.g., sewn into, glued into, bonded within, etc.) a seam of its corresponding edge(s) 43", 44", 45", 46".

Each fastener 50" may comprise a touch fastener, such as the hook element of a so-called "hook and loop" touch fastener (e.g., VELCRO brand hook 42A, etc.), with hooks that face in the same direction as the inner surface 42" of the base 40" (i.e., upwardly). In some embodiments, the engaging features (e.g., hooks, etc.) of each fastener 50" may also be oriented toward, or face the inner surface 42" of the base 40".

In some embodiments, the base 40, 40', 40" and the top 30, 30' of the duvet cover 20, 20', 20" may comprise a single piece of fabric, with a fold defining an edge (e.g., the bottom edge 23, 23') of the duvet cover 20, 20', 20".

In various embodiments, the top 30, 30' of the duvet cover 20, 20', 20" lacks visible seams or fasteners.

Figure 5:
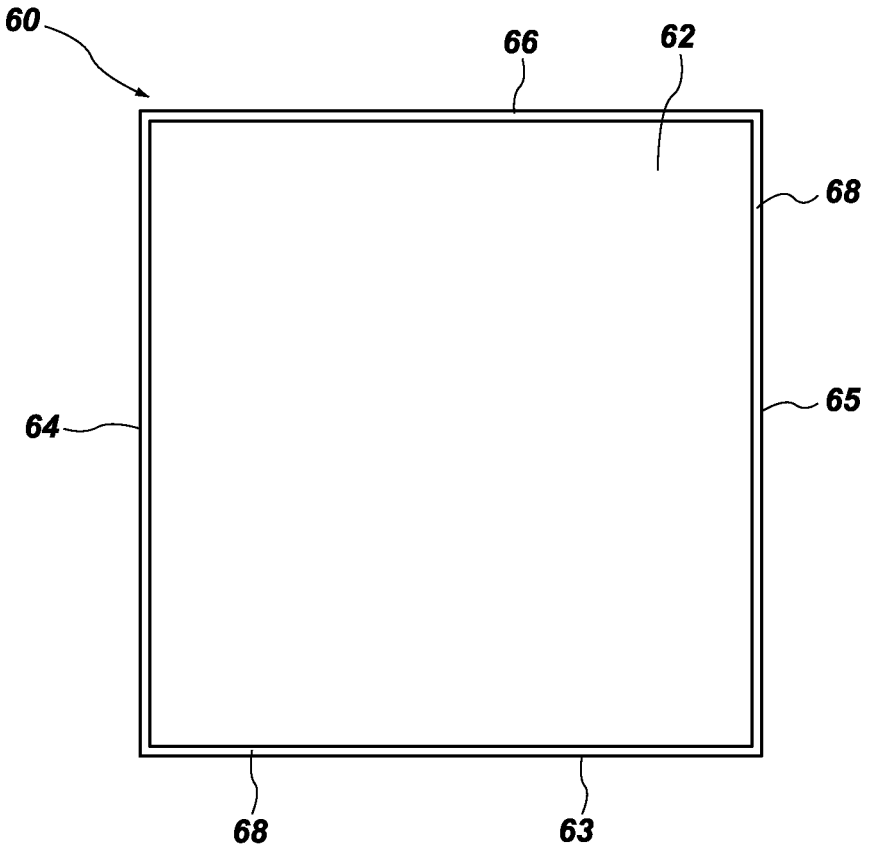
FIG. 5 is a bottom view of an embodiment of an insert of this disclosure, showing fasteners on a bottom surface of the insert.

With returned reference to FIG. 1, along with reference to FIG. 5, the insert 60 of the duvet 10 includes a first surface 61 and a second surface 62. Additionally, the insert 60 includes edges 63, 64, 65, and 66. Edge 63 may comprise a bottom edge, edge 64 may comprise a first side edge, edge 65 may comprise a second side edge, and edge 66 may comprise a top edge. The insert 60 may comprise any suitable insert for a duvet, such as a comforter, a blanket, or other bedding that will provide an individual with a desired amount of thermal insulation as the individual covers themselves with the duvet 10.

As shown in FIG. 5, a binding 68 may be provided over and carried by peripheral portions of the second surface 62 of the insert 60, at or adjacent to one or more edges 63, 64, 65, 66 (e.g., all edges, portions of all edges, opposite edges, portions of opposite edges, etc.) of the insert 60. The binding 68 may comprise a fastener that cooperates with (e.g., engages, may be engaged by, etc.) fasteners 50, 52 (FIG. 3), 50" (FIG. 4) on the inner surface 42 (FIG. 3), 42" (FIG. 4) on the base 40 (FIG. 3), 40" (FIG. 4) of the duvet cover 20 (FIG. 3), 20" (FIG. 4). In embodiments where the fasteners 50, 52, 50' comprise touch fasteners, such as hooks of hook and loop touch fasteners, the binding 68 may comprise complementary touch fasteners (e.g., loops, such as VELCRO brand loop 3905, hooks, etc.) that may face in the same direction as the second surface 62 of the insert 60. Thus, the fasteners of the binding 68 may be oriented to engage the fasteners 50, 52, 50' as the second surface 62 of the insert 60 is properly positioned over (e.g., in alignment with, etc.) and placed against the inner surface 42 (FIG. 3), 42" (FIG. 4) of the base 40, 40". In the depicted embodiment, the binding 68 may have a width of about a half an inch (about 1.25 cm)±0.0625 inch (about 2 mm).

In some embodiments, the binding 68 may wrap around one or more edges 63, 64, 65, 66 of the insert 60, with a portion of the binding 68 extending over a peripheral portion of the first surface 61 (FIG. 1) of the insert 60. Such an arrangement may provide the first surface 61 with the same appearance as the second surface 62, such as that shown in FIG. 5. In such embodiments, the binding 68 may also secure the first surface 61 of the insert 60, when the insert 60 is properly positioned over (e.g., in alignment with, etc.) the base 40 (FIG. 3), 40" (FIG. 4), to the inner surface 42 (FIG. 3), 42" (FIG. 4) of the base 40, 40".

As an alternative to including a binding 68 or other fasteners at or adjacent to its edges 63, 64, 65, 66, the first surface 61 and/or second surface 62 of the insert 60 may be at least partially formed from a fabric (e.g., a fabric with loops, etc.) that can engage or be engaged by the fasteners 50, 52 FIG. 3), 50" (FIG. 4) on the inner surface 42 (FIG. 3), 42" (FIG. 4) of the base 40 (FIG. 3), 40" (FIG. 4) of the duvet cover 20 (FIG. 3), 20" (FIG. 4).

Figure 6:
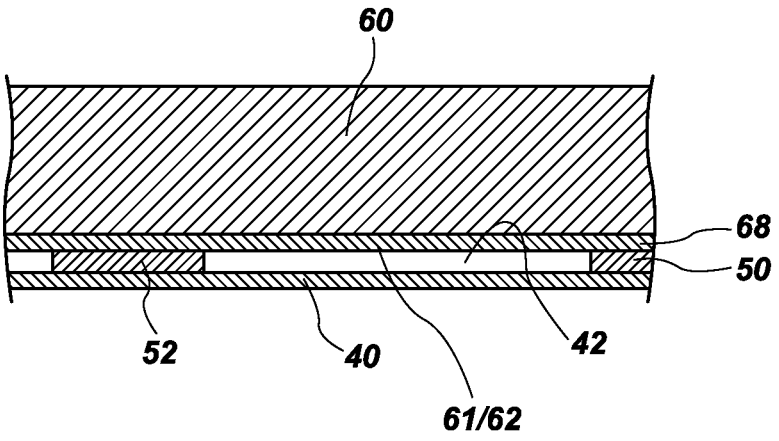
FIG. 6 is a partial cross-sectional view depicting the manner in which fasteners of the insert of the duvet and fasteners of the base of the duvet cover of the duvet cooperate to secure the insert in place within a receptacle of the duvet cover.

FIG. 6 is a partial cross-sectional view depicting the manner in which the binding 68 of the insert 60 of the duvet 10 (FIG. 1) and fasteners 50, 52 of the base 40 of the duvet cover 20 (FIG. 1) of the duvet 10 cooperate to secure the insert 60 in place within a receptacle 28 of the duvet cover 20.

With reference again returned to FIGS. 1 and 2, a method for assembling a duvet 10 may include opening (e.g., unzipping, unbuttoning, unsnapping, etc.) fasteners 27, 27' to open fastening edges 24, 26, 26' and/or partially coupled edges 24', 25' of the duvet cover 20, 20'.

With the fastening edges 24, 26, 26' and/or partially coupled edges 24', 25' open, the receptacle 28, 28' of the duvet cover 20, 20' may be accessed. In some embodiments, the top 30, 30' of the duvet cover 20, 20' may be pulled or folded over itself to expose a maximum portion of the inner surface 42, 42' of the base 40, 40' of the duvet cover 20, 20'.

The insert 60 may then be aligned with the base 40, 40' of the duvet cover 20, 20', positioned within the receptacle 28, 28' of the duvet cover 20, 20' and secured in place over the inner surface 42, 42' of the base 40, 40'. With added reference to FIGS. 3-6, In embodiments where the insert 60 includes one or more fasteners, such as the binding 68 shown in FIG. 5, the fastener of the insert 60 may be positioned over the fasteners 50, 52 (FIG. 3), 50' (FIG. 4) on the inner surface 42 (FIG. 3), 42' (FIG. 4) of the base 40, 40' of the duvet cover 20, 20'. The fastener(s) of the insert 60 may be coupled to the fasteners 50, 52, 50' of the base 40, 40'. In embodiments where the fastener(s) of the insert 60 and the fasteners 50, 52, 50' of the base 40, 40' comprise touch fasteners, the fastener(s) of the insert 60 and the fasteners 50, 52, 50' of the base 40, 40' may be secured to each other by simply placing them against each other or by additionally pressing them together.

Once the insert 60 has been secured in place over the base 40, 40' of the duvet cover 20, 20', the top 30, 30' of the duvet cover 20, 20' may be pulled over the insert 60. The opening fasteners 27, 27' may then be closed (e.g., zipped, buttoned, snapped, etc.) to close fastening edges 24, 26, 26' and/or partially coupled edges 24', 25' of the duvet cover 20, 20'.

With continued reference to FIGS. 1-6, a method of removing a duvet cover 20, 20' from an insert 60 of a duvet 10, 10' may include opening (e.g., unzipping, unbuttoning, unsnapping, etc.) fasteners 27, 27' to open fastening edges 24, 26, 26' and/or partially coupled edges 24', 25' of the duvet cover 20, 20'.

With the fastening edges 24, 26, 26' and/or partially coupled edges 24', 25' open, the receptacle 28, 28' of the duvet cover 20, 20' and the insert 60 therein may be accessed. In some embodiments, the top 30, 30' of the duvet cover 20, 20' may be pulled or folded over itself to expose a maximum portion of the insert 60.

The insert 60 may then be pulled out of the receptacle 28, 28' of the duvet cover 20, 20', away from the inner surface 42, 42' of the base 40, 40' of the duvet cover 20, 20'. In embodiments where the insert 60 includes one or more fasteners, such as the binding 68 shown in FIG. 5, the fastener of the insert 60 may be disengaged from the fasteners 50, 52 (FIG. 3), 50' (FIG. 4) on the inner surface 42 (FIG. 3), 42" (FIG. 4) of the base 40, 40' of the duvet cover 20, 20'. In embodiments where the fastener(s) of the insert 60 and the fasteners 50, 52, 50' of the base 40, 40' comprise touch fasteners, the fastener(s) of the insert 60 and the fasteners 50, 52, 50' of the base 40, 40' may disengage each other simply by pulling them away from each other.

Once the insert 60 has been removed from the receptacle 28, 28' of the duvet cover 20, 20', the duvet cover 20, 20' may be cleaned (e.g., washed, dry cleaned, etc.) and then replaced on the insert 60. Alternatively, another duvet cover 20, 20' may be assembled with the insert 60. The reassembled duvet 10, 10' may then be placed over and used on a mattress.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A duvet, comprising:

a duvet cover including:

a base including:

a top edge with a first end and a second end;

a first side edge with a top end and a bottom end, the top end of the first side edge adjoined to the first end of the top edge, the first side edge extending perpendicularly from the first end of the top edge;

a second side edge with a top end and a bottom end, the top end of the second side edge adjoined to the second end of the top edge, the second side edge extending perpendicularly from the second end of the top edge; and a bottom edge with a first end and a second end, the first end of the bottom edge adjoined to the bottom end of the first side edge, the second end of the bottom edge adjoined to the bottom end of the second side edge, the bottom edge oriented perpendicularly to the first side edge and the second side edge;

a top including:

a top edge with a first end and a second end, the top edge positionable over and reversibly securable to the top edge of the base;

a first side edge with a top end and a bottom end, the top end of the first side edge adjoined to the first end of the top edge, the first side edge extending perpendicularly from the first end of the top edge, the first side edge positionable over the first side edge of the base;

a second side edge with a top end and a bottom end, the top end of the second side edge adjoined to the second end of the top edge, the second side edge extending perpendicularly from the second end of the top edge, the second side edge positionable over the second side edge of the base, at least portion of the second side edge reversibly securable to a corresponding portion of the second side edge of the base; and a bottom edge with a first end and a second end, the first end of the bottom edge adjoined to the bottom end of the first side edge, the second end of the bottom edge adjoined to the bottom end of the second side edge, the bottom edge oriented perpendicularly to the first side edge and the second side edge, the bottom edge superimposed with and permanently secured to the bottom edge of the base;

a receptacle between the base and the top; and an insert positionable within the receptacle of the duvet cover, wherein an inner surface of the base of the duvet cover has a first at least one fastener and a surface of the insert has a second at least one fastener complementary to the first at least one fastener of the base, wherein the second at least one fastener of the insert comprises a binding and a touch fastener at or adjacent to a periphery of the insert, wherein the first at least one fastener of the base of the duvet cover comprises a plurality of touch fasteners positioned at spaced apart locations at or adjacent to a periphery of the inner surface of the base of the duvet cover, and wherein each of the plurality of touch fasteners comprise tabs with opposite surfaces that comprise fastening elements.

2. The duvet of claim 1, wherein a portion of the first side edge of the top of the duvet cover is permanently secured to a corresponding portion of the first side edge of the base of the duvet cover.

3. The duvet of claim 2, wherein a portion of the second side edge of the top of the duvet cover is permanently secured to a corresponding portion of the second side edge of the base of the duvet cover.

4. The duvet of claim 1, wherein an entirety of the first side edge of the top of the duvet cover is superimposed with and permanently secured to the first side edge of the base of the duvet cover.

5. The duvet of claim 1, wherein the top of the duvet cover is reversibly securable to the base of the duvet cover with fasteners that are not visible when the top is superimposed over the base.

6. The duvet of claim 1, wherein the base and the top of the duvet cover comprise a single piece of fabric, with a fold defining the bottom edge of the base of the duvet cover and the bottom edge of the top of the duvet cover.

7. The duvet of claim 1, wherein the top of the duvet cover lacks visible seams or fasteners.

8. The duvet of claim 1, wherein the second at least one fastener of the insert comprises a fabric of the insert.

9. A duvet, comprising:

a base including:

a top edge with a first end and a second end;

a first side edge with a top end and a bottom end, the top end of the first side edge adjoined to the first end of the top edge, the first side edge extending perpendicularly from the first end of the top edge;

a second side edge with a top end and a bottom end, the top end of the second side edge adjoined to the second end of the top edge, the second side edge extending perpendicularly from the second end of the top edge; and a bottom edge with a first end and a second end, the first end of the bottom edge adjoined to the bottom end of the first side edge, the second end of the bottom edge adjoined to the bottom end of the second side edge, the bottom edge oriented perpendicularly to the first side edge and the second side edge;

a top including:

a top edge with a first end and a second end, the top edge positionable over and reversibly securable to the top edge of the base;

a first side edge with a top end and a bottom end, the top end of the first side edge adjoined to the first end of the top edge, the first side edge extending perpendicularly from the first end of the top edge, the first side edge positionable over and reversibly securable to the first side edge of the base;

a second side edge with a top end and a bottom end, the top end of the second side edge adjoined to the second end of the top edge, the second side edge extending perpendicularly from the second end of the top edge, the second side edge positionable over the second side edge of the base, at least portion of the second side edge superimposed with and permanently secured to a corresponding portion of the second side edge of the base; and a bottom edge with a first end and a second end, the first end of the bottom edge adjoined to the bottom end of the first side edge, the second end of the bottom edge adjoined to the bottom end of the second side edge, the bottom edge oriented perpendicularly to the first side edge and the second side edge, the bottom edge superimposed with and permanently secured to the bottom edge of the base;

a receptacle defined between the base and the top, and an insert positionable within the receptacle, wherein an inner surface of the base has a first at least one fastener and a surface of the insert has a second at least one fastener complementary to the first at least one fastener, and wherein the second at least one fastener of the insert comprises a binding and a touch fastener at or adjacent to a periphery of the insert, wherein the first at least one fastener of the base of the duvet comprises a plurality of touch fasteners positioned at spaced apart locations at or adjacent to a periphery of the inner surface of the base of the duvet, and wherein each of the plurality of touch fasteners comprise tabs with opposite surfaces that comprise fastening elements.

10. The duvet of claim 9, wherein an entirety of the second side edge of the top is superimposed with and permanently secured to the second side edge of the base.

11. The duvet of claim 9, wherein the top is reversibly securable to the base with fasteners that are not visible when the top is superimposed over the base.

12. The duvet of claim 9, wherein the base and the top comprise a single piece of fabric, with a fold defining the bottom edge of the base and the bottom edge of the top.

13. The duvet of claim 9, wherein the top lacks visible seams or fasteners.

14. A duvet, comprising:

a duvet cover including:

a base including:

an inner surface;

an outer surface opposite from the inner surface and defining a lower outer surface of the duvet cover; and at least one fastener secured to the inner surface of the base, adjacent to a periphery of the inner surface; and a top including:

an inner surface; and an outer surface opposite from the inner surface and defining an upper outer surface of the duvet cover;

a receptacle defined between the inner surface of the base and the inner surface of the top; and an insert positionable within the receptacle of the duvet cover and including:

at least fastener secured to a surface of the insert adjacent to a periphery of the insert, wherein the at least one fastener of the insert is integrated into a binding at or adjacent to the periphery of the insert, wherein the at least one fastener of the duvet cover and the at least one fastener of the insert further comprises complementary touch fasteners, wherein the at least one fastener of the duvet cover further comprises a plurality of touch fasteners positioned at spaced apart locations around the periphery of the inner surface of the base of the duvet cover, and wherein the plurality of touch fasteners comprise tabs that may be moved between at least two orientations, the tabs include fastening features on opposite surfaces thereof.

15. The duvet of claim 14, wherein the plurality of touch fasteners have half hex shapes.

16. The duvet of claim 14, wherein the plurality of touch fasteners define loops at corners of the inner surface of the base of the duvet cover.

17. The duvet of claim 14, wherein the binding extends over peripheral portions of opposite surfaces of the periphery of the insert.

18. The duvet of claim 14, wherein the top of the duvet cover lacks visible seams or fasteners.

* * * * *